US005461984A

United States Patent [19]

Andress, III

[11] Patent Number: 5,461,984

[45] Date of Patent: Oct. 31, 1995

[54] APPARATUS AND METHOD FOR ENABLING A TWO-WHEELED VEHICLE TO TRAVEL ALONG A RAILROAD TRACK

[76] Inventor: F. Jay Andress, III, 3524 Holly Ave., Cincinnati, Ohio 45208

[21] Appl. No.: 153,580

[22] Filed: Nov. 16, 1993

[51] Int. Cl.[6] ..... A63G 31/00; B61F 9/00

[52] U.S. Cl. ..... 104/243; 104/53; 105/95; 280/293

[58] Field of Search ..... 104/53, 242, 243, 104/244, 246; 105/95, 72.2; 280/293, 727

[56] References Cited

U.S. PATENT DOCUMENTS

| | | | |
|---|---|---|---|
| 545,474 | 9/1985 | Fowler . | |
| 558,681 | 4/1896 | Garvey . | |
| 575,337 | 1/1897 | Dehlin et al. . | |
| 592,507 | 10/1897 | Blubaugh . | |
| 608,071 | 7/1898 | Otto et al. . | |
| 638,822 | 12/1899 | Turner . | |
| 695,826 | 3/1902 | McCormick | 105/95 |
| 705,664 | 7/1902 | Gooch . | |
| 722,078 | 3/1903 | Blomberg . | |
| 1,254,434 | 1/1918 | Rea . | |
| 1,436,532 | 11/1922 | Revny . | |
| 2,198,058 | 4/1940 | Mobeck . | |
| 4,230,046 | 10/1980 | Smart . | |
| 4,441,705 | 4/1984 | Brown . | |
| 4,802,666 | 2/1989 | Rodriqguez . | |
| 4,928,601 | 5/1990 | Harder et al. . | |

FOREIGN PATENT DOCUMENTS

| | | |
|---|---|---|
| 923964 | 7/1947 | France . |
| 356297 | 7/1922 | Germany . |
| 802575 | 7/1949 | Germany . |

OTHER PUBLICATIONS

Publication, "Rail Riders", Rail Riders Corporation, ©1984.

*Primary Examiner*—Robert J. Oberleitner
*Assistant Examiner*—S. Joseph Morano
*Attorney, Agent, or Firm*—Wood, Herron & Evans

[57] ABSTRACT

A track traveling system for enabling a two-wheeled vehicle to travel along a single rail of a railroad track has an elongated guide component (18) having vertically spaced apart guidance surfaces (24, 26) and a stabilizer component (20) that has a proximal end (28) releasably couplable to the axle and fork of a bicycle and a distal end (36) that has confronting rollers to movably bear against the vertically spaced apart guidance surfaces (24, 26) whereby the elongated guide component (18) and stabilizer component (20) cooperate to stabilize and guide the two-wheeled vehicle along a single rail of a railroad track.

77 Claims, 3 Drawing Sheets

FIG. 3
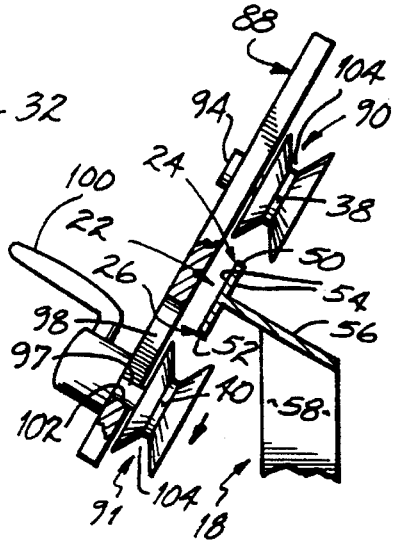
FIG. 4
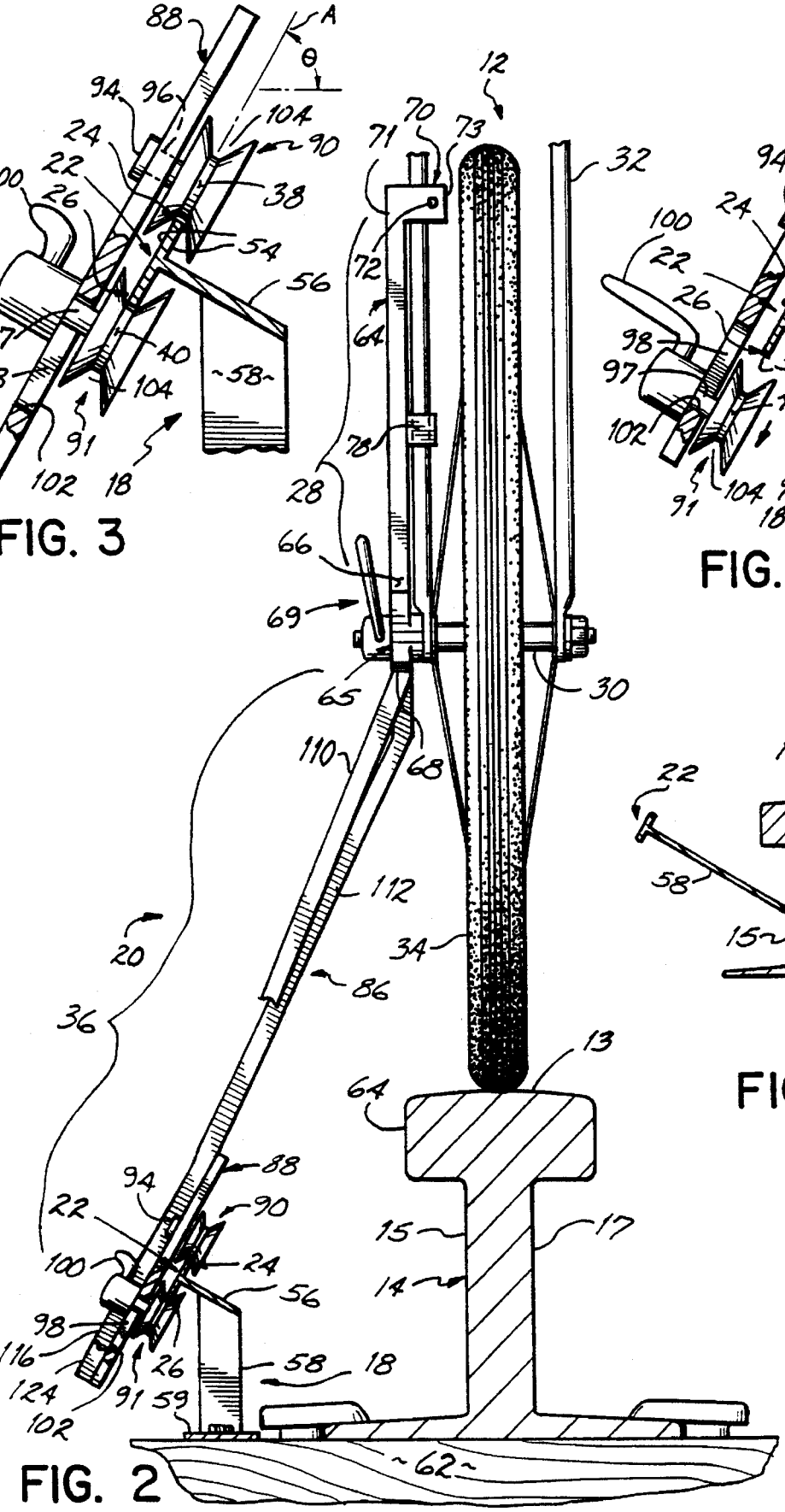
FIG. 2
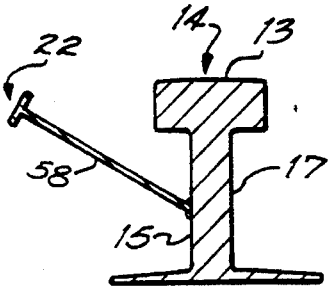
FIG. 2A

APPARATUS AND METHOD FOR ENABLING A TWO-WHEELED VEHICLE TO TRAVEL ALONG A RAILROAD TRACK

BACKGROUND OF THE INVENTION

I. Field of the Invention

The present invention relates to systems for enabling a vehicle having at least two in-line wheels to travel along a railroad track, and, more specifically, to a system for enabling a two-wheeled vehicle having a steerable wheel, such as a bicycle, to travel along a single rail of a railroad track.

II. Description of Prior Art

Due to the large expanse of unused or seldom used railroad tracks in this and other countries, many attempts have been made to provide systems for adapting a two-wheeled vehicle, such as a bicycle, for travel along railroad tracks. These attempts have been made both for recreation and transportation considerations. Typically, the adapters have comprised a bulky frame that is attached to a bicycle and includes one or more guide wheels, similar to railroad track wheels, that ride along the same rail as the bicycle and an additional guide wheel that rides along the opposing railroad track rail. However, the guide wheels merely rest upon the railroad track rail and are not attached to the rails in any manner. Thus, to prevent the rider from tipping the bicycle and frame assembly off the railroad track, either the portion of the frame along the opposing railroad track must be heavily weighted or the rider must lean in the direction of the opposing rail. Further, to stabilize the bicycle and prevent racking, thereby ensuring the bicycle wheels will remain on the railroad track, the adaptor frame is generally attached simultaneously to numerous locations along the bicycle such as to the front axle, rear axle and to other locations along the bicycle frame.

In addition to the foregoing, proposed adapters suffer from various other disadvantages as well. For example, many are large and heavy making them difficult to transport and manipulate. Also, the speed of a bicycle or other two-wheeled vehicle using such adapters may be limited because of the potential for the bicycle/adaptor assembly to leave the railroad track resulting in injury to the user. Further, by requiring the use of both rails, these adapters limit traffic along the railroad track to only one direction. Thus, there has been a significant need for a lightweight and easy to use adaptor that may be attached to a two-wheeled vehicle for enabling it to travel along a single rail of a railroad track.

SUMMARY OF THE INVENTION

The present invention provides a system for enabling a vehicle having at least two in-line wheels, such as a bicycle, to travel along a single rail of a railroad track that overcomes the above-mentioned drawbacks associated with prior adapters. More specifically, the track traveling system of the present invention provides a lightweight and portable adaptor that may be quickly and easily attached to a bicycle enabling it to safely and securely travel along a single rail of a railroad track. To this end, and in accordance with the principles of the present invention, the track traveling system includes an elongated guide component having vertically spaced apart guidance surfaces held in fixed spatial relationship near one side of a railroad track, and a stabilizer component, the proximal end of which is couplable to the steered wheel of the vehicle and the distal end of which includes spaced apart bearing surfaces that are movably secured to the guide component in bearing relationship to the guidance surfaces. When attached to the vehicle and the guide component, the stabilizer component cooperates with the guide component to stabilize and guide the vehicle along the track so that it may be safely ridden thereon, all without contacting the other railroad track.

The elongated guide component advantageously includes a web that is secured relative to the railroad track such as by struts connected either to the railroad bed or ties, or to the side of the track itself. To improve the strength and stability of the web, the guide component may include a brace extending perpendicularly from the web to which the struts are then connected. The web is held such that its longitudinal edges are positioned one above the other at an angle of about 60 degrees to the track with the upper edge closest to the track to define, in cooperation with the interconnecting faces of the web, the guidance surfaces of the guide component. The web is held in spaced relationship from the track so as to not interfere with normal train traffic upon the tracks.

The stabilizer component's proximal end includes structure to releasably couple the stabilizer component to the steered wheel's axle and fork. The distal end of the stabilizer includes a frame that supports two pair of rollers, the peripheral edges of which are in confronting relationship to define a gap therebetween. The gap is spaced to approximate the spacing of the guidance surfaces on the guide component so that, when the frame is placed onto the web, the peripheral roller edges define bearing surfaces that movably secure the stabilizer component to the guide component. To improve the guidance and stabilizing function of the rollers, they may include V-shaped grooves in their peripheral edges. The grooves facilitate contacting the web edges and adjacent portions of the web face simultaneously by the rollers. Also, the axles of one of the rollers of each pair of rollers may be selectively movable relative the other rollers so that the stabilizer component may be easily placed upon and removed from the guide component. Structure is provided to lock the movable axles in position when the stabilizer component is mounted to the guide component.

In use of the system, the stabilizer component is attached to the axle and fork of the front or steerable wheel and to the guide component. No other attachment to the vehicle or to the opposing railroad track is necessary.

By virtue of the foregoing, there is thus provided a system for enabling a two-wheeled vehicle, such as a bicycle, having a steerable wheel to safely and securely travel along a single railroad track. The systems of the present invention further permit simultaneous two-way travel on a set of railroad tracks. Additionally, cooperation of the guide component and the rollers securely holds the vehicle to the railroad track thereby permitting the two-wheeled vehicle to safely attain high speeds. A further advantage of the present invention is that the stabilizer component may be easily transported and attached to and removed from the two-wheeled vehicle because of its compactness and light weight.

These and other objects and advantages of the present invention shall become apparent from the accompanying drawings and the detailed description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the present invention.

FIG. 2 is a front, partially cross-sectional view of the track traveling system of FIG. 1 shown with the guide attached to the railroad bed ties of a railroad track;

FIG. 2A is a cross-sectional view showing an alternative method of securing the guide component of the track traveling system of FIG. 1 relative to the railroad track;

FIG. 3 is an enlarged partially cross-sectional, partial view of the guide component and rollers of the track traveling system of FIG. 1 with the rollers locked in movable contact with the guide component;

FIG. 4 is a view similar to FIG. 3 but with the rollers spaced to receive or release the guide component;

DETAILED DESCRIPTION OF THE DRAWINGS

Figure 1:
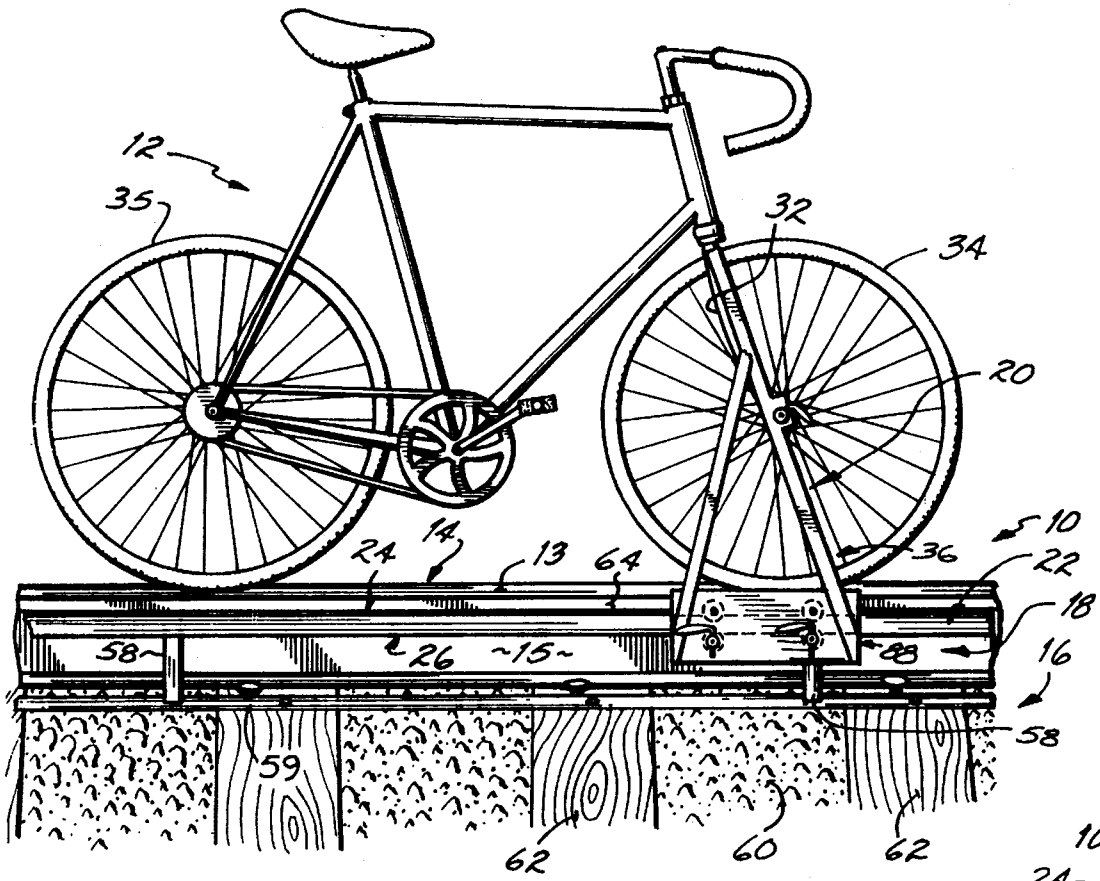
FIG. 1 is a perspective side view of a track traveling system in accordance with the principles of the present invention and shown attached to a bicycle.

With reference to FIG. 1, there is shown a track traveling system 10 for enabling a vehicle having at least two in-line wheels, one of which is steerable, such as a bicycle 12, to travel along the convex upper wheel-carrying surface 13 of a single rail 14 of a railroad track 16. Rail 14 has the usual cross-section (as seen in FIG. 2) and includes support wall sides 15, 17 below convex surface 13. Track traveling system 10 comprises an elongated guide component 18 and a stabilizer component 20. Elongated guide component 18 has an elongated guide web 22 about 1½ inches wide and about ⅛ inch thick with vertically spaced apart guidance surfaces 24, 26 that is held in fixed spatial relationship near single rail 14. Stabilizer component 20 includes a proximal end 28 that is releasably couplable to the axle 30 upon which the steerable front wheel 34 of bicycle 12 rotates and fork 32 supporting axle 30, and a distal end 36 that is movably securable to elongated guide web 22 by way of spaced apart bearing surfaces 38, 40 (see FIGS. 3 and 4) that movably bear against respective guidance surfaces 24, 26.

Referring to FIGS. 2–4, elongated guide web 22 has top edge 50, bottom edge 52 and connecting faces 54. Top edge 50 and adjacent portions of faces 54 form guidance surface 24 and bottom edge 52 along with adjacent portions of faces 54 form guidance surface 26. A support brace 56, extending medially from elongated guide web 22, may be included to provide strength and stability. However, as will be readily appreciated by those skilled in the art, elongated guide web 22 may be constructed without support brace 56.

To hold guide web 22 in fixed spatial relationship with respect to railroad track 14, struts 58 extend from brace 56 (or, alternatively, directly from guide web 22 if brace 56 is not included) and are secured to support web 59, which is in turn secured to railroad bed 60 or railroad ties 62 by way of bolts, spikes or other fastening devices. However, it will be readily apparent that struts 58 may be secured directly to railroad bed 60 or railroad ties 62 without being first secured to support web 59. Further, struts 58 may be secured directly to the support wall side 15 of single rail 14 below wheel-carrying surface 13, such as by way of welding or any other accepted technique (see FIG. 2A). Alternatively, guide web 22 may be held in place by other structures (e.g., a plate) as will be readily apparent.

Regardless of the manner that guide web 22 is spatially fixed with respect to single rail 14, it has been found advantageous to maintain a sufficient space between guide web 22 and single rail 14, such that standard railroad traffic may continue using railroad track 16 without interference from the elongated guide component 18. It has also been found that, for a typical bicycle and rider of average weight, maintaining the horizontal distance between top edge 50 and support wall 15 of single rail 14 at approximately 6 inches provides the desired spacing. Additionally, it has been found beneficial to hold elongated guide web 22 such that top edge 50 and bottom edge 52 are spaced one above the other at approximately 60 degrees causing top edge 50 to be closer to single rail 14 than bottom edge 52 for a purpose to be described below.

Figure 5:
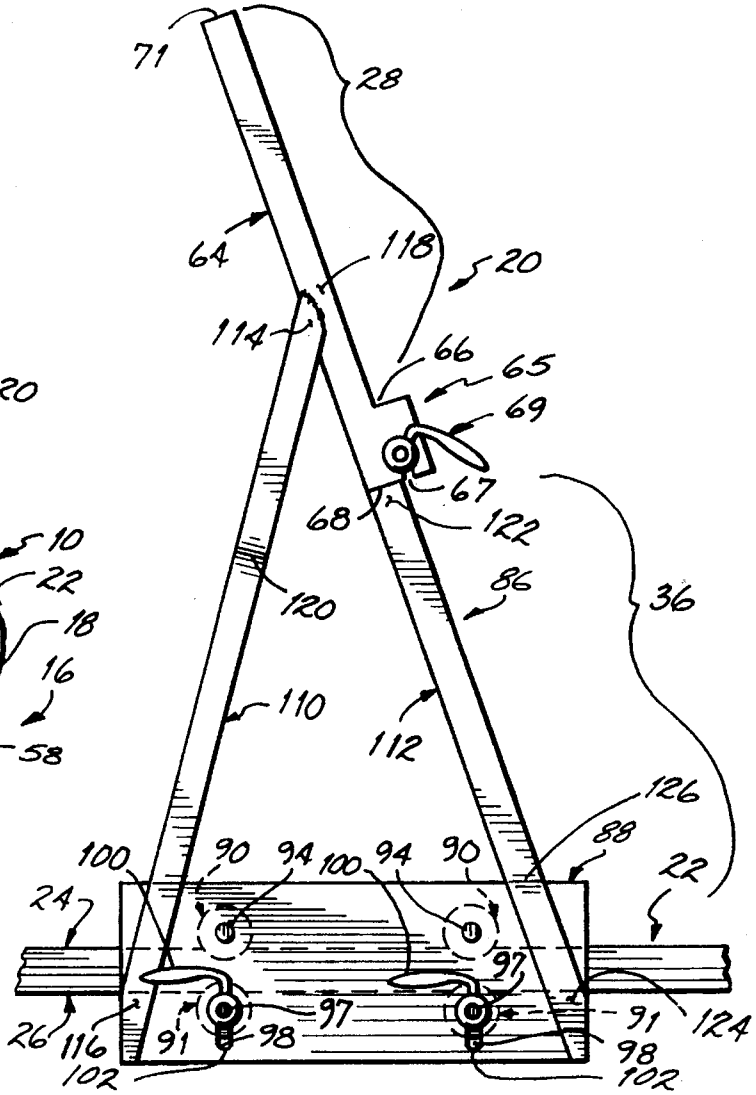
FIG. 5 is an enlarged plan side view of the stabilizing component of the track traveling system of FIG. 1.

With reference to FIG. 5, stabilizer component 20, having a proximal end 28 and distal end 36, cooperates with elongated guide component 18 and bicycle 12 to enable the bicycle to travel along a single rail 14 of a railroad track 16. For a bicycle 12 having 26 inch front and back wheels 34 and 35, respectively, as is common, proximal end 28 comprises a strut 64 about 13 inches long extending downwardly and forwardly at an angle of about 20 degrees to 30 degrees relative to vertical. However, this angle may be changed to accommodate bicycles of differing sizes. Further, strut 64 includes structure for releasably coupling stabilizer component 20 to axle 30 and fork 32 of front wheel 34.

Figure 6:
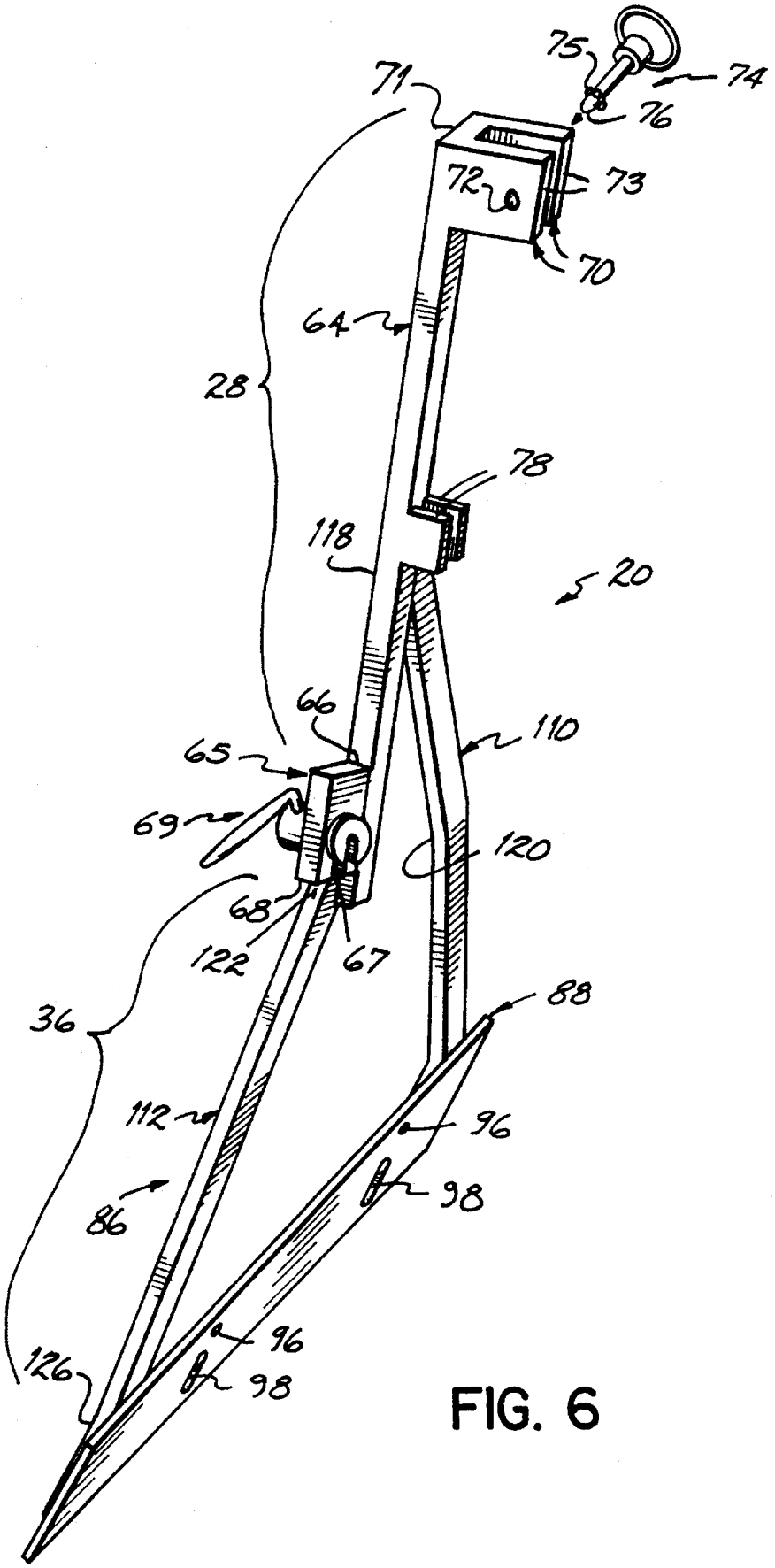
FIG. 6 is a perspective view of the stabilizing component of the track traveling system of FIG. 1.

With reference to FIGS. 5 and 6, the structure for releasably coupling proximal end 28 to axle 30 includes a rectangular bracket 65 that is about 2 inches long and extends forwardly about 1 inch from the lower end 66 of strut 64. A slot 67, sized to receive axle 30 therein, is formed in the lower edge 68 of bracket 65 and extends generally upward about 1 inch. A quick release mechanism 69, as is commonly known in the bicycle art, is attached to axle 30 and is used to releasably secure proximal end 28 to axle 30 when axle 30 is received within slot 67. The use of quick release mechanism 69 provides the advantage of allowing the user to quickly connect and disconnect stabilizer component 20 to bicycle 12. However, it will be readily appreciated that many other structures, such as, by way of example, a wing nut, may be used to releasably secure strut 64 to axle 30.

To prevent racking, a pair of tabs 70 are provided that extend laterally inward from the upper end 71 of strut 64 and are spaced to receive fork 32 therebetween (FIG. 6). Tabs 70 extend inward from about 1 inch to about 1.5 inches, however, this length may vary so long as tabs 70 do not interfere with the spokes (not numbered) of wheel 34. To releasably couple tabs 70 to fork 32, a pair of in-line apertures 72 are formed in the distal end 73 of tabs 70 to receive a removable pin 74 having outwardly biased ball bearings 75 circumferentially spaced near the front end 76. As pin 74 is inserted into apertures 72, ball bearings 75 are urged inward. Upon emerging from holes 72, ball bearings 75 spring outward, releasably locking fork 32 between tabs 70. Fork 32 is released by pulling pin 74 out of apertures 72. Use of removable pin 74 permits the user to quickly and easily secure strut 64 to fork 32. However, it will be readily appreciated that other structures may be used to secure fork 32 between tabs 70 (e.g., pin 74 may be retained within apertures 72 by a cotter pin).

Additional stability may be provided by a pair of fingers 78 spaced to receive fork 32 therebetween that extend laterally inward from strut 64 about 5 inches from lower end 66 of strut 64. Fingers 78 are similar in size to tabs 70 but do not include structure for releasably engaging fork 32. Quick release mechanism 69, tabs 70 and fingers 78 cooperate with axle 30 and fork 32 of front wheel 34 to prevent racking and steering of front wheel 34 while traveling along rail 14 when stabilizer component 20 is secured to guide component 18.

Distal end 36 of stabilizer component 20 comprises a frame 86 that extends downwardly and outwardly from strut 64. Secured to the end of frame 86 is a bracket 88 having two pairs of confronting rollers 90, 91 having a diameter of about 1½ inches. The peripheral edges of each opposing pair of rollers 90, 91 form opposing bearing surfaces 38, 40 that are spaced to movably bear against guidance bearing surfaces 24, 26 (see FIGS. 3 and 4). It will be readily appreciated that rollers 90, 91 may have larger or smaller diameters as necessary. Further, although any number of confronting rollers 90, 91 may be used, two pairs spaced apart approximately 2 to 8 times the diameter of the rollers 90, 91 along the direction parallel to guidance component 18 provide the desired stability. Thus, for example, if rollers 90, 91 are about 1½ inches in diameter, the pairs may be separated from about 3 inches to about 12 inches. For a typical bicycle, the rollers operate well with a separation of about 6 times the diameter of rollers 90, 91.

Bracket 88 is a generally rectangular plate about 12 inches long, 5 inches wide and ¼ inch thick that is attached to frame 86. As will be appreciated, the size of bracket 88 will vary with the spacing and size of rollers 90, 91 and with the size of the vehicle to which stabilizer component 20 is attached. The rollers 90 that movably bear against upper guidance surface 24 are mounted by axle pins 94 fixably secured through holes 96 (FIG. 3) in bracket 88. To enable stabilizer component 20 to be quickly and easily attached to and removed from elongated guide component 18, rollers 91 that movably bear against lower guidance surface 26 are mounted to axle pins 97 that are movable in substantially vertical slots 98 in bracket 88. The position of axle pins 97 are selectively fixed in slots 98 by way of releasable handle system 100. Handle system 100 may be any suitable locking mechanism, including a quick release mechanism similar to quick release 69. To attach stabilizer component 20 to elongated guide component 18, releasable handle system 100 is opened and rollers 91 moved to the distal end 102 of slots 98 (See FIG. 4). When rollers 91 are in their outermost position, the space between rollers 90 and 91 is sufficient to permit guide web 22 to pass completely therebetween. Stabilizer component 20 is then placed over elongated guide component 18, rollers 91 are moved into contact with elongated guide web 22 and releasable handle system 100 is put into a locked position thereby releasably locking stabilizer component 20 to elongated guide component 18 with stabilizer component 20 now able to travel along guide web 22. To remove stabilizer component 20, the reverse procedure is followed. While releasable handle system 100 is shown, it will be appreciated that many other structures including, by way of example, wing nuts, may be used to releasably lock rollers 91 within slots 98.

Rollers 90, 91 may have a flat peripheral edge (not shown) wherein the bearing surfaces will contact only top and bottom edges 50, 52 of guide web 22 and not faces 54. However, it has been found beneficial for rollers 90, 91 to have a generally V-shaped peripheral edge 104. In this configuration, bearing surfaces 38, 40 extend along the V-shaped periphery 104 such that portions of faces 54 adjacent ends 50, 52 of guide web 22 also serve as a portion of guidance surfaces 24, 26. Such a configuration provides a more positive connection between stabilizer component 20 and elongated guide component 18 and gives additional stability to the system. Further, because guidance surfaces 24, 26 are vertically displaced, rollers 90, 91 serve to prevent tipping of bicycle 12 in any direction. However, as will be readily appreciated, any perimeter that serves to retain elongated guide web 22 therein, such as, by way of example, a U-shaped periphery, may be used in place of V-shaped periphery 104.

With reference to FIG. 6, frame 86 includes a first brace strut 110 and a second brace strut 112. First brace strut 110 has an upper end 114 and lower end 116. Upper end 114 is connected to a medial part 118 of strut 64 about 6 inches from lower end 66 of strut 64. First brace strut 110 extends about 12 inches downwardly and backwardly at an angle of about 70 to about 80 degrees relative to horizontal to bend 120 and then continues, bending outwardly at an angle of about 60 degrees relative to horizontal, about 9 inches terminating at lower end 116. Lower end 116 is substantially parallel to and connected across substantially the entire width of bracket 88. Second brace strut 112 has an upper end 122 connected to lower end 66 of strut 64 and lower end 124. Second brace strut 112 extends about 12 inches downwardly and outwardly at an angle of about 65 to about 75 degrees relative to horizontal and downwardly and forwardly at an angle of about 55 to 65 degrees relative to horizontal to bend 126 where second brace strut 112 contacts bracket 88. Second brace strut 112 then extends substantially parallel to bracket 88 and is connected across the entire width thereof. Thus, strut 64, brace struts 110, 112 and bracket 88 cooperate to form a generally triangular shape to provide a lightweight, high strength structure.

Strut 64 and brace struts 110, 112 are made from aluminum and are about 1 inch wide and ½ inch thick. They are interconnected by welding or any other technique that will provide a rigid structure. Bracket 88 is also made from aluminum. Further, brace struts 110, 112 are connected to bracket 88 by welding, bolts or other technique. Additionally, as will be readily apparent, other materials and dimensions may be used so long as they result in a structure able to support the vehicle on rail 14. For example, struts 64, 110, 112 may be hollow or constructed from composite materials as are known to the bicycle art. Still further, frame 86 may be a solid web rather than comprised of struts 64, 110, 112. Other structures and materials will be readily apparent to those skilled in the art.

As described above, for a typical bicycle and rider of average weight, top edge 50 of guide web 22 is maintained at a horizontal distance of approximately 6 inches from a single rail 14. In addition to permitting standard rail traffic to continue using railroad track 16, this distance provides a moment arm which is used to balance bicycle 12 on single rail 14. Further, it has been found advantageous to maintain guide web 22 and rollers 90, 91 at an angle relative to horizontal. This has the effect of causing the out of balance forces acting through stabilizer component 20 to be generally perpendicular to guidance surfaces 24, 26 and bearing surfaces 38, 40. Further, it has been found particularly advantageous to maintain the angle of guide web 22, as measured from horizontal to a line, A, passing through guide web 22 and perpendicular to top edge 50 and bottom edge 52, at approximately 60 degrees as shown by angle θ in FIG. 3. This provides sufficient moment arm without excessive spacing. However, as will be readily appreciated, this horizontal distance and angle of tilt may be varied to accommodate vehicles having differently positioned centers of gravity or different weights and loads.

Stabilizer component 20 is considerably smaller and more light weight than prior devices and does not require structure to reach the opposing railroad track. Track traveling system 10 made in accordance with the principles of the present invention thus permits simultaneous travel on both tracks rather than travel in merely one direction, yet provides stabilization to the bicycle against tripping in any direction. Thus, there is provided a safe and secure ride at even high speeds and in many conditions.

In use, front and rear wheels 34, 35 of bicycle 12 are placed centrally on upper surface 13 of single rail 14. Stabilizer component 20 is releasably coupled to bicycle 12 at axle 30 and fork 32 of front wheel 34 by way of quick release mechanism 69, tabs 70 and fingers 78. Because stabilizer component 20 prevents tipping of bicycle 12 in any direction, there is no reason to offset bicycle 12 on upper surface 13, although it may be offset if desired. Releasable handle system 100 is unlocked and rollers 91 moved to distal end 102 of slots 98. In this position, the space between upper rollers 90 and lower rollers 91 is sufficient to permit guide web 22 to pass completely therebetween. Stabilizer component 20 is placed over guide web 22 and rollers 91 are moved into contact with guidance surface 26. Releasable handle system 100 is locked, thereby placing rollers 90, 91 in rolling engagement with guide web 22. Alternatively, the user could first movably secure stabilizer component 20 to guide web 22 and then secure stabilizer component 20 to bicycle 12. The user may then mount bicycle 12 and propel it along rail 14 by way of pedals (not numbered). Thus, stabilizer 20 and guide component 18 cooperate to maintain the wheels 34, 35 of bicycle 12 on upper surface 13 of rail 14 and to guide bicycle 12 in a direction along the longitudinal path rail 14. To remove bicycle 12 from rail 14, an opposite procedure to that for connecting bicycle 12 to rail 14 is used.

By virtue of the foregoing, there is thus provided a track traveling system that enables a two-wheeled vehicle to travel along a single rail of a railroad track.

While the present invention has been illustrated by description of embodiments which have been described in considerable detail, it is not the intention of the applicant to restrict or in any way limit the scope of the appended claims to such detail. Additional advantages will readily appear to those skilled in the art. For example, other vehicles may be substituted for bicycle 12, such as motorcycles, automobiles or other motorized devices, and still fall within the principles of the present invention. Additionally, stabilizer component 20 could be connected to bicycle 12 in more locations than that described to provide additional stability. Alternatively, stabilizer component 20 could be adapted to be connected to the frame of any vehicle having at least a pair of in-line wheels. Further, elongated guide component 18 could be movably secured to rail 14 such that it moves with bicycle 12 and stabilizer component 20 but is nevertheless spatially fixed relative to rail 14. Still further, other structures could be used in place of rollers 90, 91 to movably secure stabilizer component 20 to guide web 22, such as, by way of example, slides that travel along guidance surfaces 24, 26. Alternatively, guide web 22 could be replaced by an elongated tubular member with stabilizer component 20 having a yoke thereon sized to substantially envelope the tubular guide. The tube and ball bearings included in the yoke define the guide and bearing surfaces to provide the moving contact with the tubular guide. Thus, the invention in its broadest aspects is not limited to the specific details, representative apparatus, and illustrative example shown and described. Accordingly, departures may be made from the details without departing from the spirit or scope of applicant's general inventive concept.

I claim:

1. A system for a two-wheeled vehicle having a steerable wheel rotatable about an axle and a fork supporting said axle to enable said vehicle to travel along an elongated railroad track with its two wheels upon a top surface of said track, the system comprising:

an elongated guide component including a guide web having top and bottom edges with connecting faces, the top and bottom edges and respective adjacent portions of the faces cooperating to define spaced apart guidance surfaces, one guidance surface being elevated relative to the other, the elongated guide component further including structure for rigidly fixing the guide web relative to said railroad track with the guidance surfaces being held in fixed spatial relationship to one side of said railroad track and supporting the guide web at an angle such that the top edge of the guide web is closer to said railroad track than the bottom edge; and a stabilizer component having a proximal end being couplable to said axle and fork of said steerable wheel to secure the stabilizer component to said two-wheeled vehicle and a distal end having bearing surfaces spaced to movably bear against respective ones of the guidance surfaces of the elongated guide component, the elongated guide component and stabilizer component cooperating such that one bearing surface bears against one guidance surface when said two-wheeled vehicle tips in a direction toward the elongated guide component and the other bearing surface bears against the other guidance surface when said two-wheeled vehicle tips in a direction away from the elongated guide component, whereby the elongated guide component and stabilizer component cooperate to stabilize and guide said two-wheeled vehicle along said elongated railroad track.

2. A system for a two-wheeled vehicle having a steerable wheel rotatable about an axle and a fork supporting said axle to enable said vehicle to travel along an elongated railroad track with its two wheels upon a top surface of said track, the system comprising:

an elongated guide component having top and bottom edges with connecting faces, the top and bottom edges and respective adjacent portions of the faces cooperating to define spaced apart guidance surfaces, one guidance surface being elevated relative to the other, the guidance surfaces being held in fixed spatial relationship to one side of said railroad track;

structure supporting the elongated guide component at an angle such that the top edge of the elongated guide component is closer to said railroad track than the bottom edge; and a stabilizer component having a proximal end being couplable to said axle and fork of said steerable wheel to secure the stabilizer component to said two-wheeled vehicle and a distal end having bearing surfaces spaced to movably bear against respective ones of the guidance surfaces of the elongated guide component, the elongated guide component and stabilizer component cooperating such that one bearing surface bears against one guidance surface when said two-wheeled vehicle tips in a direction toward the elongated guide component and the other bearing surface bears against the other guidance surface when said two-wheeled vehicle tips in a direction away from the elongated guide component, whereby the elongated guide component and stabilizer component cooperate to stabilize and guide said two-wheeled vehicle along said elongated railroad track.

3. The track traveling system of claim 2 wherein the proximal end of the stabilizer component includes a strut having an upper end and lower end and axle engaging structure to releasably couple the strut to said axle of said steerable wheel.

4. The track traveling system of claim 3 further including fork clamping structure located at the upper end of the strut, the axle engaging structure being located at the lower end of the strut, whereby the axle engaging structure and fork clamping structure cooperate with said axle and fork of said steerable wheel to prevent steering of said wheel.

5. The track traveling system of claim 2 wherein the distal end of the stabilizer component includes at least one pair of rotatably supported rollers with peripheral edges thereon being spaced apart in confronting relationship to define respective ones of the bearing surfaces.

6. The track traveling system of claim 5 wherein the distal end of the stabilizer component further includes a frame extending downwardly and outwardly from the proximal end of the stabilizer component that interconnects the proximal end with the rotatably supported rollers.

7. The track traveling system of claim 5 further including a second pair of rotatably supported rollers having peripheral edges that define a second pair of spaced apart bearing surfaces.

8. The track traveling system of claim 7 wherein the two pairs of confronting rollers are spaced apart a distance of about 6 times the diameter of the rollers.

9. A system for a two-wheeled vehicle having a steerable wheel rotatable about an axle and a fork supporting said axle to enable said vehicle to travel along an elongated railroad track with its two wheels upon a top surface of said track, the system comprising:

an elongated guide component having spaced apart guidance surfaces, one guidance surface being elevated relative to the other, the guidance surfaces being held in fixed spatial relationship to one side of said railroad track; and a stabilizer component having a proximal end being couplable to said axle and fork of said steerable wheel to secure the stabilizer component to said two-wheeled vehicle, the proximal end of the stabilizer component including a strut having an upper end and a lower end, fork clamping structure located at the upper end of the strut, axle engaging structure located at the lower end of the strut to releasably couple the strut to said axle of said steerable wheel, and fork support structure located medially on the strut whereby the axle engaging structure, fork clamping structure and fork support structure cooperate with said axle and fork of said steerable wheel to prevent steering of said wheel, the stabilizer component further having a distal end having bearing surfaces spaced to movably bear against respective ones of the guidance surfaces of the elongated guide component, the elongated guide component and stabilizer component cooperating such that one bearing surface bears against one guidance surface when said two-wheeled vehicle tips in a direction toward the elongated guide component and the other bearing surface bears against the other guidance surface when said two-wheeled vehicle tips in a direction away from the elongated guide component, whereby the elongated guide component and stabilizer component cooperate to stabilize and guide said two-wheeled vehicle along said elongated railroad track.

10. The track traveling system of claim 9 wherein the axle engaging structure includes a quick-release mechanism.

11. The track traveling system of claim 9 wherein the fork clamping structure includes a pair of apertured tabs extending from the strut spaced to receive said fork of said steerable wheel therebetween and a clamping pin sized to be releasably received through the apertures, the tabs and pin cooperating to releasably couple the strut to said fork when said fork is received within the tabs.

12. The track traveling system of claim 9 wherein the fork supporting structure includes a pair of fingers extending from the strut spaced to receive said fork of said steerable wheel therebetween.

13. A system for a two-wheeled vehicle having a steerable wheel rotatable about an axle and a fork supporting said axle to enable said vehicle to travel along an elongated railroad track with its two wheels upon a top surface of said track, the system comprising:

an elongated guide component having spaced apart guidance surfaces, one guidance surface being elevated relative to the other, the guidance surfaces being held in fixed spatial relationship to one side of said railroad track; and a stabilizer component having a proximal end being couplable to said axle and fork of said steerable wheel to secure the stabilizer component to said two-wheeled vehicle and a distal end having bearing surfaces spaced to movably bear against respective ones of the guidance surfaces of the elongated guide component, wherein the distal end of the stabilizer component includes at least one pair of rotatably supported rollers with peripheral edges thereon being spaced apart in confronting relationship to define respective ones of the bearing surfaces, a frame extending downwardly and outwardly from the proximal end of the stabilizer component that interconnects the proximal end with the rotatably supported rollers, and a bracket connected to the frame that rotatably supports the rotatably supported rollers, the elongated guide component and stabilizer component cooperating such that one bearing surface bears against one guidance surface when said two-wheeled vehicle tips in a direction toward the elongated guide component and the other bearing surface bears against the other guidance surface when said two-wheeled vehicle tips in a direction away from the elongated guide component, whereby the elongated guide component and stabilizer component cooperate to stabilize and guide said two-wheeled vehicle along said elongated railroad track.

14. A system for a two-wheeled vehicle having a steerable wheel rotatable about an axle and a fork supporting said axle to enable said vehicle to travel along an elongated railroad track with its two wheels upon a top surface of said track, the system comprising;

an elongated guide component having spaced apart guidance surfaces, one guidance surface being elevated relative to the other, the guidance surfaces being held in fixed spatial relationship to one side of said railroad track; and a stabilizer component having a proximal end being couplable to said axle and fork of said steerable wheel to secure the stabilizer component to said two-wheeled vehicle and a distal end having bearing surfaces spaced to movably bear against respective ones of the guidance surfaces of the elongated guide component, wherein the distal end of the stabilizer component includes at least one pair of rotatably supported rollers with V-shaped peripheral edges thereon being spaced apart in confronting relationship to define respective ones of the bearing surfaces, the elongated guide component and stabilizer component cooperating such that one bearing surface bears against one guidance surface when said two-wheeled vehicle tips in a direction toward the elongated guide component and the other bearing surface bears against the other guidance surface when said two-wheeled vehicle tips in a direction away from the elongated guide component, whereby the elongated guide component and stabilizer component cooperate to stabilize and guide said two-wheeled vehicle along said elongated railroad track.

15. A system for a two-wheeled vehicle having a steerable wheel rotatable about an axle and a fork supporting said axle to enable said vehicle to travel along an elongated railroad track with its two wheels upon a top surface of said track, the system comprising:

an elongated guide component having spaced apart guidance surfaces, one guidance surface being elevated relative to the other, the guidance surfaces being held in fixed spatial relationship to one side of said railroad track;

a stabilizer component having a proximal end being couplable to said axle and fork of said steerable wheel to secure the stabilizer component to said two-wheeled vehicle and a distal end having at least one pair of rotatably supported rollers with peripheral edges thereon being spaced apart in confronting relationship to define respective bearing surfaces spaced to movably bear against respective ones of the guidance surfaces of the elongated guide component, the elongated guide component and stabilizer component cooperating such that one bearing surface bears against one guidance surface when said two-wheeled vehicle tips in a direction toward the elongated guide component and the other bearing surface bears against the other guidance surface when said two-wheeled vehicle tips in a direction away from the elongated guide component, whereby the elongated guide component and stabilizer component cooperate to stabilize and guide said two-wheeled vehicle along said elongated railroad track; and a selectively movable roller support on which at least one of the rollers of the at least one pair of rotatably supported rollers is rotatably mounted to selectively adjust the spacing between the roller peripheral surfaces, the roller support having a first position in which the space between the bearing surfaces is sufficient to receive therein or release therefrom the elongated guide component and a second position in which the bearing surfaces movably bear against the guidance surfaces.

16. A system for a vehicle having at least a steerable front wheel and an in-line rear wheel that are rotatably supported on a frame to enable said vehicle to travel along an elongated railroad track upon which said front and rear wheels both travel comprising:

an elongated guide component having spaced apart guidance surfaces held in fixed spatial relationship to one side of said railroad track, the guidance surfaces being held at an angle such that one guidance surface is elevated relative to, and is held at a distance closer to said railroad track than, the other; and a stabilizer component having a proximal end being couplable to said frame of said vehicle to secure said stabilizer component to said vehicle and a distal end having bearing surfaces spaced to movably bear against respective ones of the guidance surfaces of the elongated guide component, whereby the elongated guide component and stabilizer component cooperate to stabilize and guide said front and rear wheels along said railroad track.

17. The track traveling system of claim 16 wherein the elongated guide component includes a guide web having top and bottom edges with connecting faces, the top and bottom edges and respective adjacent portions of the faces cooperating to define the spaced apart guidance surfaces.

18. The track traveling system of claim 16 wherein the distal end of the stabilizer component includes at least one pair of rotatably supported rollers with peripheral edges thereon being spaced apart in confronting relationship to define respective ones of the bearing surfaces.

19. The track traveling system of claim 18 wherein the peripheral edges of the rollers are V-shaped.

20. The track traveling system of claim 18 further including a second pair of rotatably supported rollers having peripheral edges that define a second pair of spaced apart bearing surfaces.

21. The track traveling system of claim 20 further comprising a selectively movable roller support on which at least one of the rollers of the at least one pair of rotatably supported rollers is rotatably mounted to selectively adjust the spacing between the roller peripheral surfaces, the roller support having a first position in which the space between the bearing surfaces is sufficient to receive therein or release therefrom the elongated guide component and a second position in which the bearing surfaces movably bear against the guidance surfaces.

22. A system for a two-wheeled vehicle having a steerable front wheel rotatable about an axle and a fork supporting said axle and a rear wheel in-line with the front wheel to enable said vehicle to travel along an elongated railroad track having a surface upon which said two wheels both travel comprising:

an elongated guide component having an elongated guide web and structure for securing the elongated guide component in fixed spatial relationship with respect to said railroad track, the elongated guide web having top and bottom edges with connecting faces, the top and bottom edges and respective adjacent portions of the faces cooperating to define spaced apart guidance surfaces; and a stabilizer component including a first strut having axle engaging structure for releasably coupling the first strut to said axle of said front wheel, fork clamping structure for releasably coupling the first strut to said fork of said front wheel, and fork support structure to support said fork, second and third struts extending downwardly and outwardly from the first strut, and a bracket secured to the second and third struts having two pairs of confronting rollers with peripheral edges thereon to define bearing surfaces to movably bear against the respective ones of the guidance surfaces, at least one of the rollers of each pair being selectively movable in a direction perpendicular to the guidance surfaces to enable the stabilizer component to be releasably secured to the elongated guide component, whereby the elongated guide component and stabilizer component cooperate to stabilize and guide said two-wheeled vehicle along said elongated railroad track.

23. The track traveling system of claim 22 wherein the axle engaging structure includes a quick-release mechanism.

24. The track traveling system of claim 22 wherein the fork clamping structure includes a pair of apertured tabs extending from the first strut spaced to receive said fork of said steerable wheel therebetween and a clamping pin sized to be releasably received through the apertures, the tabs and pin cooperating to releasably couple the first strut to said fork when said fork is received within the tabs.

25. The track traveling system of claim 22 wherein the fork supporting structure includes a pair of fingers extending from the first strut spaced to receive said fork of said steerable wheel therebetween.

26. The track traveling system of claim 22 wherein the two pairs of confronting rollers are spaced apart a distance of about 6 times the diameter of the rollers.

27. The track traveling system of claim 22 wherein said railroad track is secured to a railroad bed, the structure for securing the elongated guide component including holding struts having first ends and second ends and a support web, the first ends of the holding struts being interconnected to the guide web and the second end connected to the support web, the support web being connected to said railroad bed.

28. The track traveling system of claim 27 wherein said railroad track has a support wall side below said surface of said railroad track, the structure for securing the guide component supporting the guide web at an angle of about 60 degrees relative to horizontal and holding the top edge of the guide web approximately 6 inches horizontally from the track support wall side.

29. An elongated guide component adapted to cooperate with a two-wheeled vehicle having a steerable wheel rotatable about an axle and a fork supporting said axle, and a stabilizer component having a proximal end being couplable to said axle and said fork and a distal end being movably couplable to the guide component to enable said two-wheeled vehicle to travel along the top surface of an elongated railroad track comprising:

spaced apart guidance surfaces, one guidance surface being elevated relative to the other; and structure for holding the guidance surfaces in fixed spatial relationship to one side of said railroad track such that the elevated guidance surface is closer to said railroad track than the other guidance surface.

30. The elongated guide component of claim 29 further including a guide web having opposing surfaces that form respective ones of the guidance surfaces.

31. The elongated guide component of claim 30 wherein the structure for holding the guidance surfaces in fixed spatial relationship is adapted to rigidly fix the guide web relative to said railroad track.

32. The elongated guide component of claim 31, the structure for rigidly fixing the guide web relative to said railroad track including struts having first ends and second ends and a support web, the first ends of the struts interconnected to the guide web and the second end connected to the support web, the support web being connectable to said railroad track.

33. The elongated guide component of claim 31, the structure for rigidly fixing the guide web relative to said railroad tracks including struts having first ends interconnected to the guide web and second ends for connecting to a railroad bed of the railroad tracks.

34. The elongated guide component of claim 33 wherein the strut second ends are configured for connection to railroad ties of the railroad bed.

35. The elongated guide component of claim 31, the structure for rigidly fixing the guide web relative to said railroad track including struts having first ends interconnected to the guide web and second ends connectable to said railroad track.

36. The elongated guide component of claim 35 wherein the strut second ends are configured for attachment to a track support wall side of the railroad track.

37. The elongated guide component of claim 30 wherein the guide web has top and bottom edges with connecting faces, the top and bottom edges and respective adjacent portions of the faces cooperating to define the spaced apart guidance surfaces.

38. The elongated guide component of claim 37 wherein the structure for holding the guidance surfaces in fixed spatial relationship to said railroad track being adaptable to support the guide web at an angle such that the top edge of the guide web is closer to said railroad track than said bottom edge.

39. The elongated guide component of claim 37 wherein the structure for holding the guidance surfaces in fixed spatial relationship to said railroad track being adaptable to support the guide web at an angle of about 60 degrees relative to horizontal with the top edge of the guide web being closer to said railroad track than said bottom edge.

40. The elongated guide component of claim 39 wherein the structure for holding the guidance surfaces in fixed spatial relationship to said railroad track is adaptable for holding the top edge of the guide web approximately 6 inches horizontally from a track support wall side of the railroad track.

41. The elongated guide component of claim 29 further including top and bottom edges with connecting faces, the top and bottom edges and respective adjacent portions of the faces cooperating to define the spaced apart guidance surfaces.

42. The elongated guide component of claim 41, the structure holding the guidance surfaces being further adaptable for holding the elongated guide component at an angle such that the top edge of the elongated guide component is closer to said railroad track than the bottom edge.

43. The elongated guide component of claim 41, the structure holding the guidance surfaces being further adaptable for holding the elongated guide component at an angle of about 60 degrees relative to horizontal with the top edge of the elongated guide component being closer to said railroad track than the bottom edge.

44. The elongated guide component of claim 41 wherein the structure holding the guidance surfaces is further adaptable for holding the top edge of the elongated guide component approximately 6 inches from a track support wall side of the railroad track.

45. A stabilizer component adapted to be couplable with a two-wheeled vehicle having a steerable wheel rotatable about an axle and a fork supporting said axle, and an elongated guide component having spaced apart respective guidance surfaces, one guidance surface being elevated relative to the other, said respective guidance surfaces being held in fixed spatial relationship to one side of said railroad track to enable said two-wheeled vehicle to travel along the top surface of an elongated railroad track comprising:

a proximal end being couplable to said axle and fork of said steerable wheel to secure the stabilizer component to said two-wheeled vehicle, the proximal end including a strut having an upper end and a lower end, fork clamping structure located at the upper end of the strut wherein the fork clamping structure includes a pair of apertured tabs extending from the strut spaced to receive said fork of said steerable wheel therebetween and a clamping pin sized to be releasably received through the apertures, the tabs and pin adapted to releasably couple the strut to said fork when said fork is received within the tabs; and a distal end having bearing surfaces adapted to movably bear against said respective guidance surfaces of said elongated guide component, the stabilizer component cooperable with said elongated guide component and said two-wheeled vehicle such that in use one bearing surface will bear against one of said guidance surfaces when said two-wheeled vehicle tips in a direction toward said elongated guide component and the other bearing surface will bear against said other guidance surface when said two-wheeled vehicle tips in a direction away from said elongated guide component.

46. The stabilizing component of claim 45, the proximal end further including axle engaging structure on the strut adapted to releasably couple the strut to said axle of said steerable wheel.

47. The stabilizer component of claim 46 wherein the axle engaging structure includes a quick release mechanism.

48. The stabilizing component of claim 46, the axle engaging structure being located at the lower end of the strut, the axle engaging structure and fork clamping structure being adapted to cooperate with said axle and fork of said steerable wheel to prevent steering of said wheel.

49. The stabilizer component of claim 45 wherein the axle engaging structure includes a quick-release mechanism.

50. The stabilizer component of claim 45 wherein the distal end includes at least one pair of rotatably supported rollers with peripheral edges thereon being spaced apart in confronting relationship to define respective ones of the bearing surfaces.

51. The stabilizer component of claim 50 wherein the distal end further includes a frame extending downwardly and outwardly from the proximal end that interconnects the proximal end with the rotatably supported rollers.

52. The stabilizer component of claim 50 further including a second pair of rotatably supported rollers having peripheral edges that define a second pair of spaced apart bearing surfaces.

53. The stabilizer component of claim 52 wherein the two pairs of confronting rollers are spaced apart a distance of about 2 to about 8 times the diameter of the rollers.

54. The stabilizer component of claim 53 wherein the two pairs of confronting rollers are spaced apart a distance of about 6 times the diameter of the rollers.

55. A stabilizer component adapted to be couplable with a two-wheeled vehicle having a steerable wheel rotatable about an axle and a fork supporting said axle, and an elongated guide component having spaced apart respective guidance surfaces, one guidance surface being elevated relative to the other, said respective guidance surfaces being held in fixed spatial relationship to one side of said railroad track to enable said two-wheeled vehicle to travel along the top surface of an elongated railroad track comprising:

a proximal end being couplable to said axle and fork of said steerable wheel to secure the stabilizer component to said two-wheeled vehicle, the proximal end including a strut having an upper end and a lower end, fork clamping structure located at the upper end of the strut, axle engaging structure located at the lower end of the strut, and fork support structure located medially on the strut, the axle engaging structure, fork clamping structure and fork support structure being adapted to cooperate with said axle and fork of said steerable wheel to prevent steering of said wheel; and a distal end having bearing surfaces adapted to movably bear against said respective guidance surfaces of said elongated guide component, the stabilizer component cooperable with said elongated guide component and said two-wheeled vehicle such that in use one bearing surface will bear against one said guidance surfaces when said two-wheeled vehicle tips in a direction toward said elongated guide component and the other bearing surface will bear against said other guidance surface when said two-wheeled vehicle tips in a direction away from said elongated guide component.

56. The stabilizer component of claim 55 wherein the axle engaging structure includes a quick-release mechanism.

57. The stabilizer component of claim 55 wherein the fork clamping structure includes a pair of apertured tabs extending from the strut spaced to receive said fork of said steerable wheel therebetween and a clamping pin sized to be releasably received through the apertures, the tabs and pins adapted to releasably couple the strut to said fork when said fork is received within the tabs.

58. The stabilizer component of claim 55 wherein the fork support structure includes a pair of fingers extending from the strut spaced to receive said fork of said steerable wheel therebetween.

59. A stabilizer component adapted to be couplable with a two-wheeled vehicle having a steerable wheel rotatable about an axle and a fork supporting said axle, and an elongated guide component having spaced apart respective guidance surfaces, one guidance surface being elevated relative to the other, said respective guidance surfaces being held in fixed spatial relationship to one side of said railroad track to enable said two-wheeled vehicle to travel along the top surface of an elongated railroad track comprising:

a proximal end being couplable to said axle and fork of said steerable wheel to secure the stabilizer component to said two-wheeled vehicle; and a distal end having at least one pair of rotatably supported rollers with peripheral edges thereon being spaced apart in confronting relationship to define respective bearing surfaces adapted to movably bear against said respective guidance surfaces of said elongated guide component, wherein the distal end further includes a frame extending downwardly and outwardly from the proximal end that interconnects the proximal end with the rotatably supported rollers and a bracket connected to the frame that rotatably supports the rotatably supported rollers, the stabilizer component cooperable with said elongated guide component and said two-wheeled vehicle such that in use one bearing surface will bear against one of said guidance surfaces when said two-wheeled vehicle tips in a direction toward said elongated guide component and the other bearing surface will bear against said other guidance surface when said two-wheeled vehicle tips in a direction away from said elongated guide component.

60. The stabilizer component of claim 59 wherein the frame includes a pair of brace struts having first ends and second ends, the first ends being connected to the proximal end, the brace struts extending downwardly and outwardly from the proximal end and the second ends being connected to the bracket.

61. A stabilizer component adapted to be couplable with a two-wheeled vehicle having a steerable wheel rotatable about an axle and a fork supporting said axle, and an elongated guide component having spaced apart respective guidance surfaces, one guidance surface being elevated relative to the other, said respective guidance surfaces being held in fixed spatial relationship to one side of said railroad track to enable said two-wheeled vehicle to travel along the top surface of an elongated railroad track comprising:

a proximal end being couplable to said axle and fork of said steerable wheel to secure the stabilizer component to said two-wheeled vehicle; and a distal end having at least one pair of rotatably supported rollers with V-shaped peripheral edges thereon being spaced apart in confronting relationship to define respective bearing surfaces adapted to movably bear against said respective guidance surfaces of said elongated guide component, the stabilizer component cooperable with said elongated guide component and said two-wheeled vehicle such that in use one bearing surface will bear against one of said guidance surfaces when said two-wheeled vehicle tips in a direction toward said elongated guide component and the other bearing surface will bear against said other guidance surface when said two-wheeled vehicle tips in a direction away from said elongated guide component.

62. A stabilizer component adapted to be couplable with a two-wheeled vehicle having a steerable wheel rotatable about an axle and a fork supporting said axle, and an elongated guide component having spaced apart respective guidance surfaces, one guidance surface being elevated relative to the other, said respective guidance surfaces being held in fixed spatial relationship to one side of said railroad track to enable said two-wheeled vehicle to travel along the top surface of an elongated railroad track comprising:

a proximal end being couplable to said axle and fork of said steerable wheel to secure the stabilizer component to said two-wheeled vehicle;

a distal end having at least one pair of rotatably supported rollers with peripheral edges thereon being spaced apart in confronting relationship to define respective bearing surfaces adapted to movably bear against said respective guidance surfaces of said elongated guide component;

a second pair of rotatably supported rollers having peripheral edges that define a second pair of bearing surfaces; and a selectively movable roller support on which at least one of the rollers of each of the pairs of rollers is rotatably mounted to selectively adjust the spacing between the roller peripheral surfaces, the roller support having a first position in which the space between the bearing surfaces is sufficient to receive therein or release therefrom said elongated guide component and a second position in which the bearing surfaces are spaced to movably bear against said guidance surfaces, the stabilizer component cooperable with said elongated guide component and said two-wheeled vehicle such that in use one bearing surface will bear against one of said guidance surfaces when said two-wheeled vehicle tips in a direction toward said elongated guide component and the other bearing surface will bear against said other guidance surface when said two-wheeled vehicle tips in a direction away from said elongated guide component.

63. A method of enabling a two-wheeled vehicle having a steerable wheel rotatable about an axle and a fork supporting said axle to travel along an elongated railroad track having a surface upon which said two wheels travel comprising:

situating an elongated guide component having vertically spaced apart first and second guidance surfaces in fixed spatial relationship to said railroad track with the guidance surfaces at an angle such that the first guidance surface is (i) elevated relative to the second guidance surface and (ii) held at a distance closer to said railroad track than, the second guidance surface;

placing a two-wheeled vehicle upon said surface of said railroad track;

providing a stabilizer component having a proximal end including structure for releasably coupling the stabilizer component to said axle and fork of said steerable wheel and a distal end having at least two rotatably supported confronting rollers with peripheral edges thereon to define bearing surfaces to movably bear against respective ones of the guidance surfaces, the roller that movably bears against one of the guidance surfaces being selectively movable in a direction perpendicular to the guidance surfaces to enable the stabilizer component to be releasably secured to the elongated guide component;

releasably coupling the stabilizer component to said two-wheeled vehicle;

releasably securing the stabilizer component to the elongated guide component; and propelling said two-wheeled vehicle whereby the stabilizer component and elongated guide component cooperate to stabilize and guide the two-wheeled vehicle along said railroad track.

64. The method of enabling a two-wheeled vehicle to travel along a railroad track of claim 63, further comprising rigidly fixing the elongated guide component relative to said railroad track.

65. The method of enabling a two-wheeled vehicle to travel along a railroad track of claim 64 wherein the elongated guide component includes a guide web having top and bottom edges with connecting faces, the method further comprising defining the spaced apart guidance surfaces by the top and bottom edges and respective adjacent portions of the faces and supporting the guide web at an angle such that the top edge of the guide web is closer to said railroad track than the bottom edge.

66. The method of enabling a two-wheeled vehicle to travel along a railroad track of claim 63, further comprising associating a strut having an upper end and a lower end with the proximal end of the stabilizer component and wherein releasably coupling the stabilizer component to said two-wheeled vehicle includes releasably coupling axle engaging structure at the lower end of the strut to said axle, and releasably coupling fork clamping structure at the upper end of the strut to said fork.

67. The method of enabling a two-wheeled vehicle to travel along a railroad track of claim 66 wherein the fork clamping structure includes a pair of apertured tabs extending from the strut spaced to receive said fork therebetween and a clamping pin sized to be releasably received through the apertures, and wherein releasably coupling the fork clamping structure to said fork includes placing said fork between the tabs and inserting the clamping pin into the apertures.

68. The method of enabling a two-wheeled vehicle to travel along a railroad track of claim 63, further comprising rotatably supporting the rotatably supported rollers on a bracket on the distal end of the stabilizer component and interconnecting the bracket to the proximal end of the stabilizer component with a frame extending downwardly and outwardly from the proximal end of the stabilizer.

69. The method of enabling a two-wheeled vehicle to travel along a railroad track of claim 63, further comprising forming the peripheral edges of the rollers to have a V-shape.

70. The method of enabling a two-wheeled vehicle to travel along a railroad track of claim 63, the stabilizer component including a second pair of rotatably supported rollers having peripheral edges that define a second pair of spaced apart bearing surfaces, at least one of the rollers of each pair of rollers being selectively movable between a first position in which the space between bearing surfaces is sufficient to receive therein or release therefrom the elongated guide component and a second position in which the bearing surfaces movably bear against the guidance surfaces, wherein releasably securing the stabilizer component to the elongated guide component includes:

selectively moving the at least one roller of each pair of rollers to the first position;

receiving the elongated guide component between the bearing surfaces; and selectively moving the at least one roller of each pair of rollers to the second position.

71. A method of enabling a vehicle having at least a steerable front wheel and an in-line rear wheel that are rotatably supported on a frame to enable said vehicle wheels to travel along a single rail of an elongated railroad track, said single rail having an upper surface upon which said front and rear wheels both travel comprising:

situating an elongated guide component having spaced apart guidance surfaces in fixed spatial relationship to one side of said single rail and at a distance less than the distance to an opposing rail of said railroad track;

elevating one guidance surface relative to the other;

placing a steerable front wheel and an in-line rear wheel of said vehicle upon said upper surface of said single rail of said railroad track;

providing a stabilizer component having a proximal end adapted to be releasably coupled to said frame of the vehicle and a distal end having bearing surfaces adapted to be releasably secured to the elongated guide component to movably bear against respective ones of the guidance surfaces;

releasably coupling the stabilizer component to said frame of the vehicle;

releasably securing the stabilizer component to the elongated guide component; and propelling said vehicle whereby the stabilizer component and the elongated guide component cooperate to stabilize and guide the vehicle along said railroad track.

72. A system for a two-wheeled vehicle having a steerable wheel rotatable about an axle and a fork supporting said axle to enable said vehicle to travel along a single rail of an elongated railroad track with its two wheels upon a top surface of said single rail, the system comprising:

an elongated guide component having spaced apart guidance surfaces, one guidance surface being elevated relative to the other, the guidance surfaces being held in fixed spatial relationship to said single rail and at a distance less than the distance to an opposing rail of said railroad track; and a stabilizer component having a proximal end being couplable to said axle and said fork of said vehicle to secure said stabilizer component to said vehicle and a distal end having bearing surfaces spaced to movably bear against respective ones of the guidance surfaces of the elongated guide component, whereby the elongated guide component and stabilizer component cooperate to stabilize and guide said front and rear wheels along said railroad track.

73. The track traveling system of claim 72 wherein the elongated guide component includes a guide web having top and bottom edges with connecting faces, the top and bottom edges and respective adjacent portions of the faces cooperating to define the spaced apart guidance surfaces.

74. The track traveling system of claim 73 wherein the structure for holding the elongated guide component in fixed spatial relationship to one side of said single rail supports the guide web at an angle such that the top edge of the guide web is closer to said single rail than the bottom edge.

75. The track traveling system of claim 72, the stabilizer component further comprising:

a strut at the proximal end of the stabilizer component, the strut having an upper end and a lower end;

axle engaging structure at the lower end of the strut adapted to releasably couple the strut to said axle of said stearable wheel;

fork clamping structure at the upper end of the strut adapted to receive said fork; and fork support structure located medially on the strut, the axle engaging structure, fork clamping structure, and fork support structure cooperating with said axle and said fork of said steerable wheel to prevent steering of said wheel.

76. The track traveling system of claim 72 wherein the distal end of the stabilizer component includes at least one pair of rotatably supported rollers with peripheral edges thereon being spaced apart in confronting relationship to define respective ones of the bearing surfaces.

77. The track traveling system of claim 76 further comprising a selectively movable roller support on which at least one of the rollers of the at least one pair of rotatably supported rollers is rotatably mounted to selectively adjust the spacing between the roller peripheral surfaces, the roller support having a first position in which the space between the bearing surfaces is sufficient to receive therein or release therefrom the elongated guide component and a second position in which the bearing surfaces movably bear against the guidance surfaces.

* * * * *